US008171869B2

(12) United States Patent
Ware

(10) Patent No.: US 8,171,869 B2
(45) Date of Patent: May 8, 2012

(54) AUTOMATED WATER SAFETY APPARATUS

(76) Inventor: Leslie Dale Ware, Dallas, TX (US)

( * ) Notice: Subject to any disclaimer, the term of this patent is extended or adjusted under 35 U.S.C. 154(b) by 39 days.

(21) Appl. No.: 12/400,072

(22) Filed: Mar. 9, 2009

(65) Prior Publication Data

US 2010/0227518 A1 Sep. 9, 2010

(51) Int. Cl.
*B63B 43/10* (2006.01)

(52) U.S. Cl. ..... 114/68; 114/69

(58) Field of Classification Search ..... 169/37; 114/68, 69

See application file for complete search history.

(56) References Cited

U.S. PATENT DOCUMENTS

| | | | | |
|---|---|---|---|---|
| 3,059,253 | A * | 10/1962 | Sager | 441/80 |
| 6,327,988 | B1 * | 12/2001 | Seidel | 114/68 |
| 2003/0213420 | A1 * | 11/2003 | Mears et al. | 114/68 |
| 2006/0237198 | A1 * | 10/2006 | Crampton | 169/15 |

* cited by examiner

*Primary Examiner* — Stephen Avila
(74) *Attorney, Agent, or Firm* — George T. Scott

(57) ABSTRACT

An automated water safety apparatus is disclosed including, a spray device, a sensor, a container, a processor capable of sending and receiving signals, and a liquid substance that becomes a buoyant solid when released from the spray device, wherein the water safety device is coupled to a water vessel. Additionally, a method is disclosed for creating buoyant solids in water in response to a water vessel beginning to sink, including determining whether the water vessel is sinking, sending a signal to the processor to indicate that the vessel is sinking, the processor instructing the container to release the liquid substance, and propelling the liquid substance into the water to form buoyant solids.

20 Claims, 5 Drawing Sheets

40
12
54
48
36
38

AUTOMATED WATER SAFETY APPARATUS

FIELD OF THE INVENTION

This invention relates in general to the field of water safety devices, and more particularly to an improved device for water safety and method for using the same.

BACKGROUND

Many avoidable deaths occur each year when water vessels sink and passengers drown. Additionally, many people are reluctant to travel by water due to the actual or perceived concerns over the safety of the water vessel that they would be travelling on. Further, many water vessels have outdated or less than adequate safety devices due to cost and difficulty of maintenance and installation.

One present water safety method requires a water vessel to possess one flotation device per passenger. If a water vessel begins to sink, each passenger must then find a flotation device, which can be difficult in such a high stress situation. Furthermore, many water vessels do not actually possess the proper amounts of flotation devices due to the cost and storage space required.

Another present water safety method consists of a water vessel possessing enough inflatable rafts to support all of the passengers on the water vessel. This method requires less storage space than other methods, but does not alleviate the difficulties in readying the flotation devices in high stress situations. These devices must be inflated by a pump, an air compressor, or similar device. Some devices can be inflated instantly with compressed air devices, but some knowledge of how to use the device is required.

These techniques work, but are burdensome and not efficient. A solution that does not require passengers to know how to use it is needed. Additionally, a solution that alleviates storage, maintenance, and cost concerns is needed. There is also need for a water safety device that works in response to emergency situations as opposed to working in response to human being's reaction to emergency situations.

SUMMARY OF THE INVENTION

In accordance with the present invention, an automatic water safety apparatus is provided which substantially eliminates or reduces disadvantages and problems associated with previous systems and methods.

In accordance with one embodiment of the present invention, an automated water safety apparatus includes a spray device capable of releasing a liquid substance, a container for storing the liquid substance, a tilt sensor, and a processor capable of sending and receiving [signals]. The liquid substance is any liquid substance that becomes buoyant once released from the spray device. Additionally, the water safety device is coupled to a water vessel. More specifically, in one embodiment of the present invention, the spray device is capable of rotating horizontally about an axis. In another embodiment of the present invention, the spray device releases an intermittent stream that forms a plurality of buoyant solids in the water.

In accordance with another embodiment of the present invention, a method for creating buoyant solids in response to a water vessel beginning to sink includes determining whether a water vessel is sinking and, if the water vessel is sinking, sending a signal to a processor indicating that the water vessel is sinking. The method also includes the processor sending a signal to the container instructing the container to release the liquid substance. Additionally, the method includes releasing the liquid substance from the container to the spray device and propelling the liquid substance from the spray device into the water. More specifically, in one embodiment of the present invention, a tilt sensor determines whether the water vessel is sinking and sends a signal to the processor. In another embodiment of the present invention, a water height sensor determines whether the water vessel is sinking and sends a signal to the processor.

Depending on the specific features implemented, particular embodiments of the present invention may exhibit some, none, or all of the following technical advantages. Technical advantages of particular embodiments of the present invention include the ability of the water safety apparatus to automatically respond to a water emergency situation without the need for human interaction. Another technical advantage of particular embodiments of the present invention includes the creation of a plurality of flotation devices by propelling a liquid substance into water, where the liquid substance has the property of becoming a buoyant solid when released from the spray device.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention and its advantages, reference is now made to the following description taken in conjunction with the accompanying drawings, in which like reference numbers indicate like features, and.

DETAILED DESCRIPTION OF THE INVENTION

Figure 1:
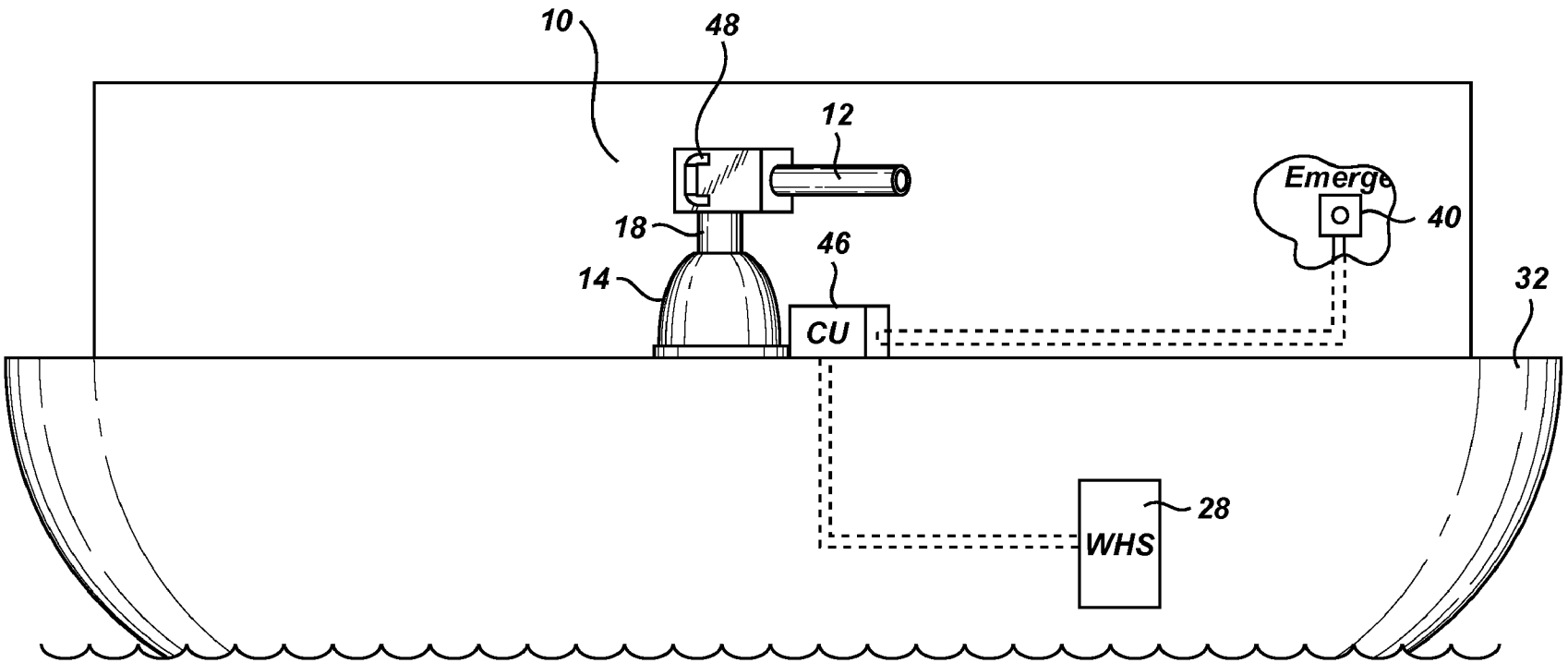
FIG. 1 illustrates a side view of an automated water safety device in accordance with one embodiment of the present invention.

FIG. 1 is a side view of an automated water safety device 10 in accordance with one embodiment of the present invention. The automated water safety device 10 is coupled to a water vessel 32. Generally, the water vessel 32 is a water vessel intended for mass transportation, such as a ferry, a steamboat, a cruise ship, or a barge. In other embodiments of the present invention, the water vessel 32 may be a water vessel for personal transportation or any other type of water vessel on which human beings will be aboard. Typically, the automated water safety device 10 is coupled to perimeter of the upper surface of water vessel 32, which is the deck of most water vessels. However, in other embodiments, the automated water safety device 10 can be placed in locations other than the perimeter of the upper surface of water vessel 32, or alternatively, locations other than the upper surface of water vessel 32.

In one embodiment of the present invention, automated water safety device 10 includes a container 14 coupled to water vessel 32. Container 14 is one such that it may contain a liquid substance. Additionally, Container 14 may be also be capable of holding a pressurized liquid substance in some embodiments of the present invention. In another embodiment of the present invention, more than one container 14 may be used. In such an embodiment, each container may hold a different substance than one another, wherein the substances of each container combine together to form a liquid substance that becomes a buoyant solid 38 when propelled from spray device 12. In addition, Container 14 is coupled to a Container Release Controller 42. Container Release Controller 42 may be a release valve in some embodiments of the present invention, but may be any other type of device that controls whether substance will be released from container 14.

Automated water safety device 10 also includes a spray device 12. Spray device 12 may be any type of device that is capable of propelling a liquid substance, such as the types of spray devices commonly found on fire fighting vehicles. In one embodiment of the present invention, spray device 12 is coupled to a shaft 18, which is coupled to the top surface of container 14. Alternatively, spray device 12 can be coupled to the top surface of container 14, eliminating the inclusion of shaft 18. In another embodiment of the present invention, spray device 12 rotates horizontally about shaft 18, enabling spray device 12 to point in a plurality of directions. Alternatively, if spray device 12 is coupled to the top portion of container 14, spray device 12 can rotate horizontally about container 14 in one embodiment of the present invention. In another embodiment of the present invention, handles 48 are coupled to spray device 12 to allow for the manual aiming of automated water safety device 10.

In another embodiment of the present invention, automated water safety device 10 also includes a controller unit 46. Controller unit 46 is coupled to container release controller 42. In one embodiment of the present invention, controller unit 46 may be coupled to one or more sensors, such as a water height sensor 28. Water height sensor 28, in one embodiment of the present invention, controller unit 46 includes a processor 20 and a tilt sensor 24. An example of tilt sensor 24 is the SB2i Dual Axis Inclinometer Sensor manufactured by Reiker Incorporated, but many other variations are available. Additionally, control unit 46 may be coupled to a manual switch 40. Generally, manual switch 40 is a button, but can be any type of triggering device such as a lever, a switch, an input for voice command, or a keypad. In some embodiments of the present invention, one or more of the sensors coupled to control unit 46 will be coupled wirelessly and communicate via wireless signals, such as radio frequency (RF).

Figure 2:
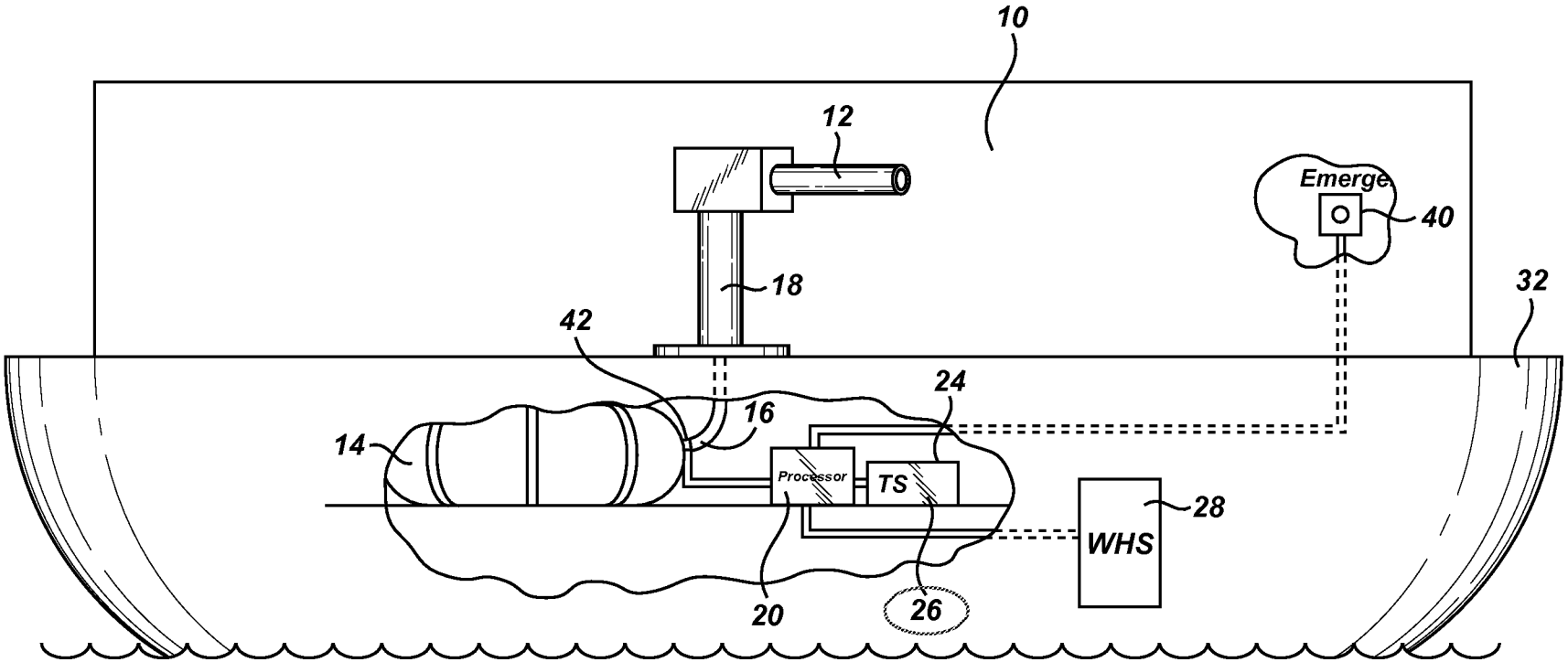
FIG. 2 illustrates a side view of an automated water safety device in accordance with an alternative embodiment of the present invention.

FIG. 2 is a side view of an automated water safety device 10 in accordance with another embodiment of the present invention. In one embodiment of the present invention, automated water safety device 10 includes a spray device 12 coupled to a shaft 18. Generally, shaft 18 is coupled to the top surface of water vessel 32, but may be coupled to other locations on water vessel 32 in alternative embodiments of the present invention. Automated water safety apparatus 10 further includes a container 14 that is coupled to shaft 18 by tube 16. Tube 16 can be constructed from a variety of materials, such as rubber, polyvinyl chloride (PVC), aluminum, a combination thereof, or any other number of materials that are commonly used to transport liquid. In some embodiments of the present invention, container 10 may be located below the top surface of water vessel 32. Thus, one embodiment of the present invention allows for an automated water safety apparatus 10 where only spray device 12 and shaft 18 are visible to passengers on water vessel 32.

In one embodiment of the present invention, automated water safety apparatus 10 further includes a processor 20 that is coupled to container release controller 42 and at least one sensor. The sensor coupled to processor 20 may be a tilt sensor 24 in one embodiment of the present invention. In another embodiment of the present invention, the sensor coupled to processor 20 may be a water height sensor 28. In yet another embodiment of the present invention, both tilt sensor 24 and water height sensor 28 may be coupled to processor 20. Additionally, another embodiment of the present invention may include a manual switch 40 that is coupled to the processor 20.

Figure 3:
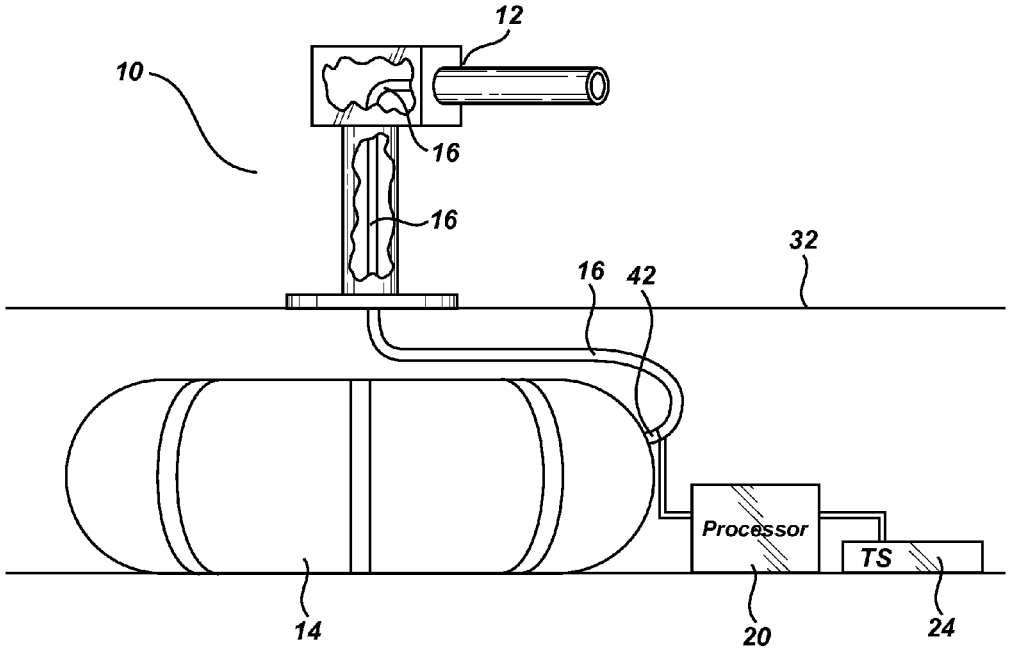
FIG. 3 illustrates a schematic view of the components of one embodiment of the present invention.

Now referring to FIG. 3, tube 16 couples container 14 to spray device 12 in one embodiment of the present invention. In such a configuration, tube 16 is partially located inside the hollow portion of shaft 18, with one length of tube 16 extending out of one end of shaft 18, and the other length of tube 16 extending out of the opposite end of shaft 18. One of the lengths of tube 16 is coupled to container 14 and the opposite end of tube 16 is coupled to spray device 12.

Figure 4:
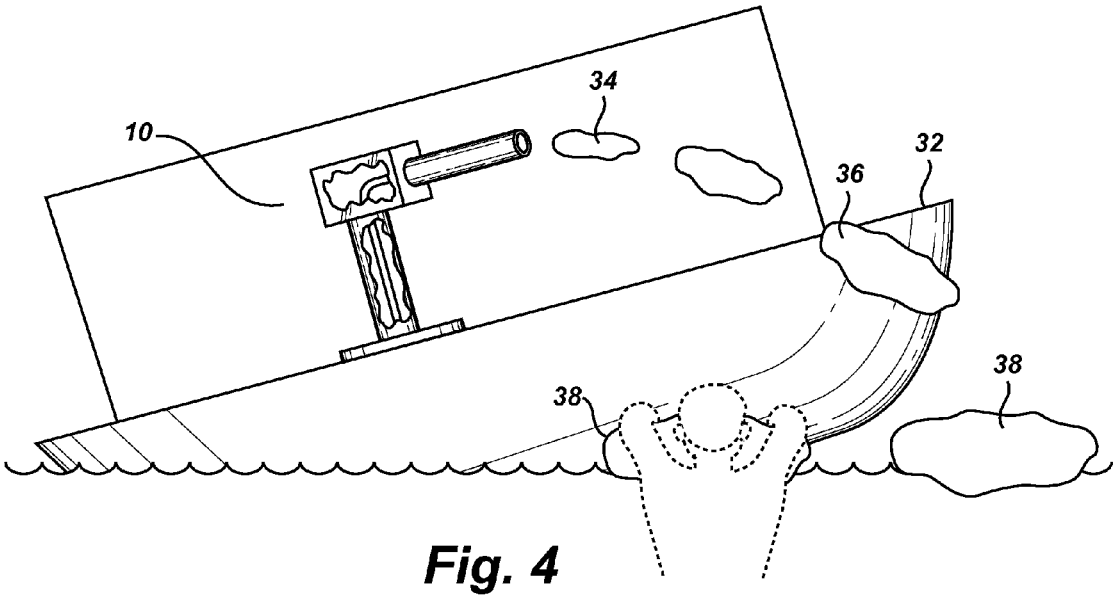
FIG. 4 illustrates one embodiment of the present invention after it is determines that the water vessel is sinking.

FIG. 4 illustrates the one embodiment of the present invention after it is determined that the water vessel is sinking. In FIG. 4, it is apparent that water vessel 32 is tilted upwards from back to front. Such an occurrence can be an indication that water vessel 32 is sinking. Upon such determination, automated water safety apparatus 10 propels a liquid substance that becomes a buoyant solid 38 when released from spray device 12. In one embodiment of the present invention, when the liquid substance is first released from spray device 12, it begins to become a buoyant solid. As the liquid solid nears the water, it further transforms into a buoyant solid. In one embodiment of the present invention, it increases in size as this process occurs. The result is a buoyant semi-solid 36. In one embodiment of the present invention, automated water safety apparatus 10 may propel the liquid substance in intermittent bursts, as is portrayed in FIG. 4. In another embodiment of the present invention, automated water safety apparatus 10 may propel the liquid substance in a continuous stream, creating at least one buoyant solid 38.

One example of a liquid substance having the property of becoming a buoyant solid 38 when propelled from spray device 12 is Great Stuff™, a polyurethane foam sealant manufactured by The Dow Chemical Company. Another example is DAP® KWIK FOAM®, a polyurethane foam sealant manufactured by DAP Products, Inc. Additionally, any liquid substance that becomes a buoyant solid when released from a spray device 12 may be used by the present invention.

Figure 5:
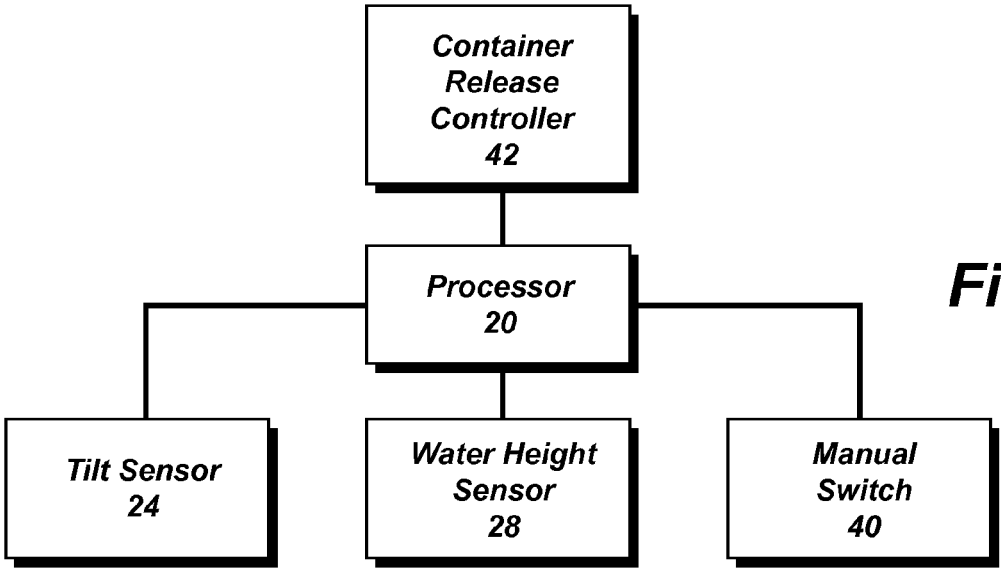
FIG. 5 illustrates the interconnection of certain components of the embodiment of the present invention illustrated in FIG. 2.

FIG. 5 is a diagram view of how several of the components of one embodiment of the present invention are coupled to one another. In some embodiments of the present invention, the various components represented in FIG. 5 will be coupled by wire capable of carrying electronic signals. In other embodiments of the present invention, the various components represented in FIG. 5 will be coupled wirelessly. In other embodiments of the present invention, some of the various components represented in FIG. 5 will be coupled by wire capable of carrying electronic signals, whereas other components represented in FIG. 5 will be coupled wirelessly.

Water Height Sensor 28, Tilt Sensor 24, Manual Switch 40, and Container Release Controller 42 are all coupled to Processor 20.

Figure 6:
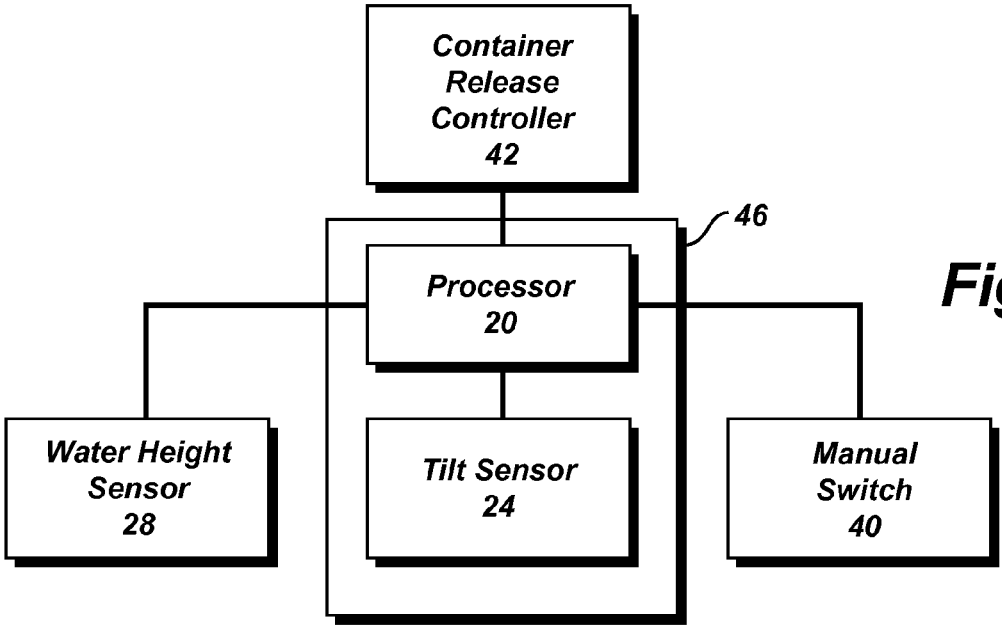
FIG. 6 illustrates the interconnection of certain components of the embodiment of the present invention illustrated in FIG. 1.
Figure 7:
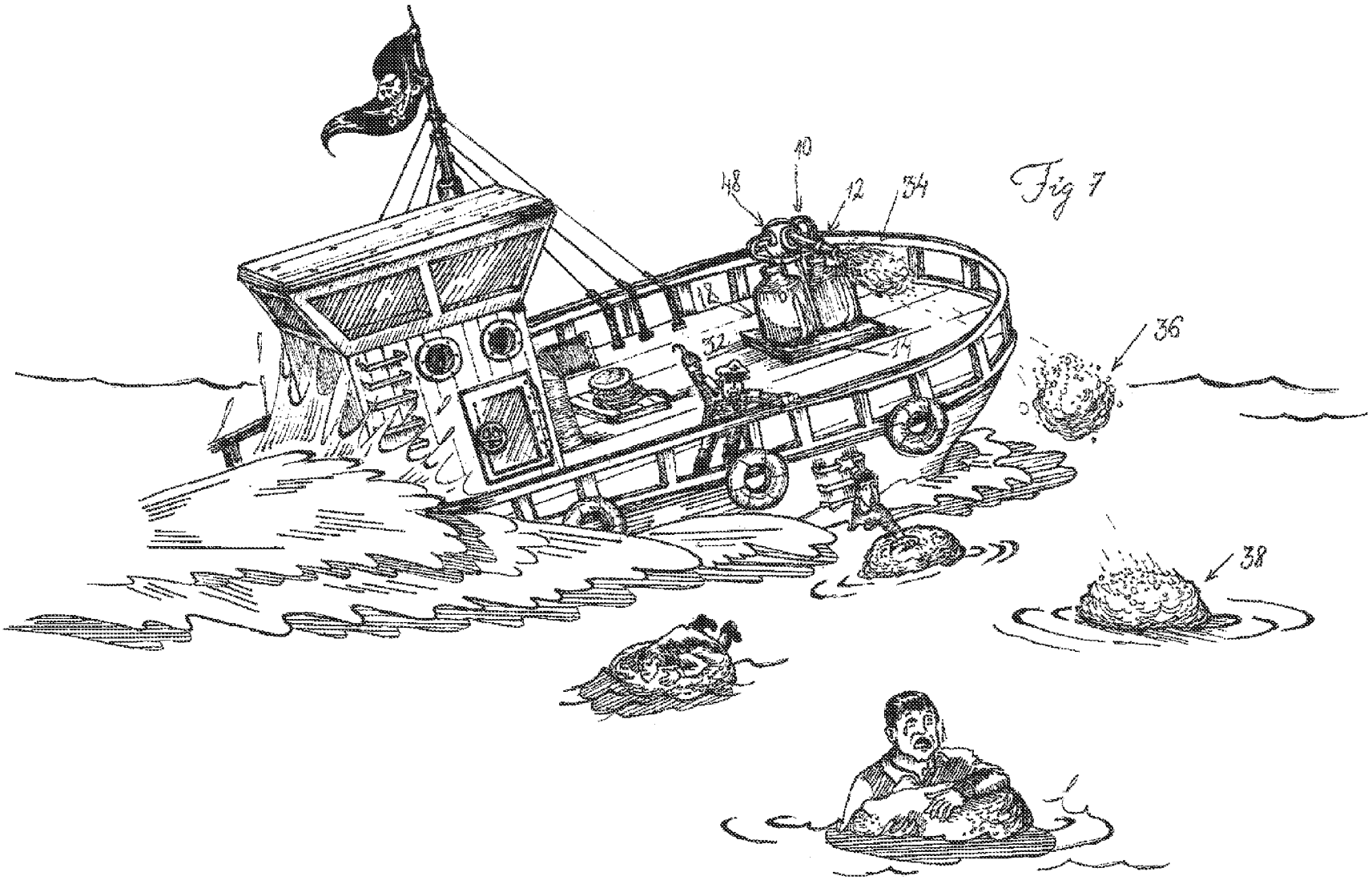
FIG. 7 illustrates one embodiment of the present invention functioning during a water emergency.

FIG. 6 is a diagram view of how several of the components of another embodiment of the present invention are coupled to one another. In some embodiments of the present invention, the various components represented in FIG. 6 will be coupled by wire capable of carrying electronic signals. In other embodiments of the present invention, the various components represented in FIG. 6 will be coupled wirelessly. In other embodiments of the present invention, some of the various components represented in FIG. 6 will be coupled by wire capable of carrying electronic signals, whereas other components represented in FIG. 6 will be coupled wirelessly. Control Unit 46 includes Processor 20 and Tilt Sensor 24. Water Height Sensor 28, Tilt Sensor 24, Manual Switch 40, and Container Release Controller 42 are all coupled to Processor 20.

In one embodiment of the present invention, automated water safety device 10 remains in a ready state while water vessel 32 is in operation. During this ready state, the electronic components of the system are powered on. The automated water safety device 10 stays in this state until the system 10 determines that water vessel 32 is sinking.

In one embodiment of the present invention, automated water safety apparatus 10 may determine that water vessel 32 is sinking by using tilt sensor 24. Tilt sensor 24 may rest parallel to the surface of water vessel 32. When the front of water vessel 32 is higher than the back of the vessel, or vice versa, tilt sensor 24 sends a signal to processor 20. In some embodiments of the present invention, tilt sensor 24 may measure tilt on multiple axes, so that tilt sensor 24 may send a signal to processor 20 when the top surface of water vessel 32 deviates a predetermined amount of degrees in any direction from parallel to the water surface.

In another embodiment of the present invention, automated water safety apparatus 10 may determine that water vessel 32 is sinking by using water height sensor 28. Generally, water height sensor 28 will be located on the side portion of water vessel 32, but may be located in a plurality of alternative locations. When water level on the side of water vessel 32 reaches a point that is the same height laterally as water height sensor 28, water height sensor 28 sends a signal to processor 20. One advantage of including a water height sensor in addition to a tilt sensor is that certain water vessels may not deviate from a plane parallel with the water surface while sinking, but may rather remain level while the water level on the side of the vessel rises higher.

When tilt sensor 24 or water height sensor 28 detect conditions that are indicative of a sinking vessel, they send a signal to processor 20. Processor 20 may contain logic to determine whether the signal received indicates that water vessel 32 is sinking, or whether some other conditions, such as rough water, caused the sensor to send a signal. For example, tilt sensor 24 may send signals every time water vessel's 32 top surface is not parallel with the water surface within a predetermined number of degrees; however, processor's 20 logic may only react to the signal if it is continuous, indicating that the vessel is maintaining the incline rather than just rocking back and forth. Alternatively, tilt sensor 24 and water height sensor 28 may be configured to only send a signal to processor 20 when the tilt or water height conditions are such that they indicate water vessel 32 is sinking, thus minimizing false negative signals.

In another embodiment of the present invention, a human being on water vessel 32 may determine that water vessel 32 is sinking. In such a situation, the human being would press or otherwise activate manual switch 40 to send a signal to processor 20.

Once processor 20 receives a signal from either a sensor or manual switch 40, processor 20 sends a signal to container release controller 42, causing container release controller 42 to release the liquid substance from container 14. In one embodiment of the present invention, the liquid substance may be pressurized inside of container 14. In such an embodiment, the liquid substance exits container 14 once container release controller 42 releases the liquid substance, and begins to move through tube 16 towards spray device 12. Alternatively, a liquid substance may be used that has the property of expanding once released from a confined space, or a compressor may be used to force the liquid substance out of container 14. Once the liquid substance exits container 14, it enters tube 16 and continues through tube 16 towards spray device 12.

When the liquid substance reaches spray device 12, it is propelled from spray device 12 towards the water surface. In one embodiment of the present invention, the liquid substance may begin to expand rapidly to a fully buoyant solid 38 before it reaches the water surface. In another embodiment of the present invention, the liquid substance may still be a buoyant semi-solid 36 that continues to solidify and/or expand after it reaches the water surface. Further, in some embodiments of the present invention, container release controller 42 may intermittently stop releasing the liquid substance from container 14, causing the liquid substance to be propelled from spray device 12 intermittently, producing a plurality of buoyant solids. Additionally, in some embodiments of the present invention, spray device 12 will rotate horizontally about an axis that is parallel to shaft 18. The spray device may rotate back forth along an arc of less than 180 degrees in order to only propel the liquid substance into the water, however the arc may vary depending on the placement of the automated water safety device 10.

In one embodiment of the present invention, a plurality of buoyant solids 38 will be floating in the water surrounding the sinking water vessel 32 after it has been determined that water vessel 32 is sinking. In one embodiment of the present invention, these buoyant solids 38 will be proportioned as to allow a single person to grasp onto one of the plurality of buoyant solids 38 until help arrives. In another embodiment of the present invention, buoyant solids 38 will be large enough to support a plurality of persons until help arrives.

Although the illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed:

1. An automated water safety apparatus, comprising:

a spray device capable of propelling a liquid substance towards the water surrounding the water vessel;

a sensor;

a container for storing liquid that is coupled to the spray device;

a processor capable of sending and receiving signals that is coupled to the sensor and the container, and wherein the processor contains logic for differentiating signals received from the sensor that are indications of rough water conditions from signals that indicate the water vessel is sinking;

a liquid substance that becomes a buoyant solid when released from the spray device;

wherein the automated water safety apparatus is coupled to a water vessel.

2. The apparatus of claim 1, further comprising a triggering device for manually activating the spray device.

3. The apparatus of claim 1, wherein the sensor is a tilt sensor capable of measuring incline on at least one axis.

4. The apparatus of claim 1, wherein the sensor is a water height sensor capable of determining whether water has reached a predetermined point on a water vessel.

5. The apparatus of claim 1, wherein the liquid substance is a pressurized liquid substance that becomes a buoyant solid when depressurized.

6. The apparatus of claim 1, wherein the container further comprises a plurality of containers for holding distinct substances that combine to form the liquid substance.

7. The apparatus of claim 1, wherein the spray device can rotate horizontally about an axis.

8. The apparatus of claim 1, wherein the spray device releases a continuous stream that forms one buoyant solid in the water.

9. The apparatus of claim 1, wherein the spray device releases an intermittent stream that forms a plurality of buoyant solids in the water.

10. The apparatus of claim 1, wherein the container forms the base of the water safety apparatus.

11. The apparatus of claim 10, wherein the spray device is coupled to the top portion of the container.

12. The apparatus of claim 1, wherein the processor, the container, and the sensor send and receive signals wirelessly.

13. A method for creating buoyant solids in response to a water vessel beginning to sink, the steps comprising of:

determining whether the water vessel is sinking;

sending a signal to the processor indicating that the water vessel is sinking, wherein the processor contains logic for differentiating signals received from the sensor that are indications of rough water conditions from signals that indicate the water vessel is sinking;

the processor sending a signal to the container instructing the container to release the liquid substance;

releasing the liquid substance from the container to the spray device;

propelling the liquid substance from the spray device towards the water surrounding the water vessel, wherein the liquid substance becomes a buoyant solid when released from the spray device.

14. The method of claim 13, wherein the step of determining whether the water vessel is sinking is performed by a tilt sensor.

15. The method of claim 14, wherein the signal sent to the processor is sent by the tilt sensor.

16. The method of claim 13, wherein the determination of whether the water vessel is sinking is performed by a human being.

17. The method of claim 16, wherein the signal is sent to the processor by activating the triggering device.

18. The method of claim 13, wherein the step of determining whether the water vessel is sinking is performed by the water height sensor.

19. The method of claim 18, wherein the signal sent to the processor is sent by the water height sensor.

20. The method of claim 13, wherein at least one of the signals received by the processor or sent by the processor are received or sent wirelessly.

* * * * *